US008928433B2

(12) United States Patent
Jinnai

(10) Patent No.: US 8,928,433 B2
(45) Date of Patent: Jan. 6, 2015

(54) WAVEGUIDE FILTER

(75) Inventor: Taketoshi Jinnai, Tokyo (JP)

(73) Assignee: NEC Corporation, Tokyo (JP)

( * ) Notice: Subject to any disclaimer, the term of this patent is extended or adjusted under 35 U.S.C. 154(b) by 454 days.

(21) Appl. No.: 12/997,322

(22) PCT Filed: Jun. 18, 2009

(86) PCT No.: PCT/JP2009/061539

§ 371 (c)(1),
(2), (4) Date: Dec. 10, 2010

(87) PCT Pub. No.: WO2009/157494

PCT Pub. Date: Dec. 30, 2009

(65) Prior Publication Data

US 2011/0084783 A1 Apr. 14, 2011

(30) Foreign Application Priority Data

Jun. 23, 2008 (JP) ..... 2008-162768

(51) Int. Cl.
*H01P 1/207* (2006.01)

(52) U.S. Cl.
CPC ..... *H01P 1/207* (2013.01)
USPC ..... 333/209

(58) Field of Classification Search
CPC ..... H01P 1/20; H01P 1/207; H01P 1/2138; H01P 11/007; H01P 3/12; H01P 3/122
USPC ..... 333/135, 157, 208–209, 212, 239, 248
See application file for complete search history.

(56) References Cited

U.S. PATENT DOCUMENTS

| | | | | |
|---|---|---|---|---|
| 4,761,625 | A | 8/1988 | Sharma | |
| 6,657,520 | B2 * | 12/2003 | Mack et al. | 333/208 |
| 6,756,866 | B1 * | 6/2004 | Higgins | 333/157 |
| 6,823,178 | B2 * | 11/2004 | Pleasant et al. | 455/119 |
| 7,068,129 | B2 * | 6/2006 | Higgins et al. | 333/209 |
| 2013/0235962 | A1 * | 9/2013 | O'Keefe et al. | 375/371 |

FOREIGN PATENT DOCUMENTS

| | | | |
|---|---|---|---|
| JP | 2002353703 | A | 12/2002 |
| JP | 2007088545 | A | 4/2007 |
| WO | 2004059784 | A | 7/2004 |

OTHER PUBLICATIONS

J.A. Higgins, H. Xin, A. Sailer, M. Rosker "Ka-Band Waveguide Phase Shifter Using Tunable Electromagnetic Crystal Sidewalls", IEEE Trans. on Microwave Theory and Techniques, vol. 51, No. 4, Apr. 2003, pp. 1281-1288.*

International Search Report for PCT/JP2009/061539 mailed Oct. 6, 2009.

Y. Qin et al., "Improved Slotted-Filter for Over-Mode Rectangular Waveguide", 1996 4th International Conference on Millimeter Wave and Far Infrared Science and Technology Proceedings, IEEE Press, 1996, pp. 218-221.

* cited by examiner

*Primary Examiner* — Benny Lee
*Assistant Examiner* — Rakesh Patel
(74) *Attorney, Agent, or Firm* — Sughrue Mion, PLLC

(57) ABSTRACT

A waveguide filter comprises a dielectric board on at least one of the two E-planes of a rectangular waveguide. The dielectric board comprises a conductive pattern formed on one surface thereof and having a slit extending in a signal propagation direction, and a ground pattern formed on the other surface.

11 Claims, 6 Drawing Sheets

WAVEGUIDE FILTER

This application is the National Phase of PCT/JP2009/061539, filed Jun. 18, 2009, which is based upon and claims the benefit of priority from Japanese patent application No. 2008-162768, filed Jun. 23, 2008, the disclosure of which is incorporated herein in its entirety by reference.

TECHNICAL FIELD

This invention relates to a high-frequency filter, and particularly to a waveguide filter.

BACKGROUND ART

Referring to FIG. 12, an example of a high-frequency BPF (Band Pass Filter) will be described.

As shown in FIG. 12, this high-frequency BPF is formed by dividing a rectangular waveguide into two halves 110 and 120 along a signal propagation direction at the center of an H-plane, and interposing a thin metal fin 130 having a plurality of windows between these two halves 110 and 120. This type of high-frequency BPF is also referred to as an E-plane waveguide-type BPF.

The characteristics of the E-plane waveguide-type BPF are determined depending on the shapes of the metal fin 130 and the waveguide (particularly, the length of the long side (width) of the cross-section of the rectangular waveguide). Therefore, the shape of the metal fin 130 or the cross-sectional shape of the rectangular waveguide must be changed in order to change, for example, the central frequency of the BPF.

Japanese Laid-Open Patent Publication No. 2007-88545 (Patent Document 1) discloses a BPF which is designed such that the central frequency or frequency bandwidth can be electrically adjusted in order to enlarge the coverable frequency bandwidth.

Briefly describing this BPF, the metal fin 130 shown in FIG. 12 is replaced with a three-layer substrate having a resonator, and the resonator has an active element provided therein. In this BPF, the central frequency or bandwidth is adjusted by applying a bias voltage from the outside of the three-layer substrate to the active element through a line pattern in the intermediate layer of the three-layer substrate.

SUMMARY OF THE INVENTION

However, even in the BPF disclosed in Patent Document 1, the frequency adjustable range is too narrow to expect a dynamic adjustment of frequency, and hence it is difficult to satisfy the characteristics required for actual applications.

Therefore this invention seeks to provide a waveguide filter capable of changing the central frequency easily without changing the shape, particularly the cross-sectional dimensions of the metal fin or waveguide.

According to an aspect of this invention, it provides a waveguide filter comprising, on an E-plane of a waveguide, a dielectric portion having a conductive pattern formed on one surface thereof, the conductive pattern having a slit extending in a signal propagation direction.

The dielectric portion is desirably formed by a dielectric board having the conductive pattern formed on one surface thereof and having the slit extending in the signal propagation direction, and a ground pattern formed on the other surface.

In the waveguide filter described above, a plurality of conductive through holes may be provided along the slit to extend from a region of the conductive pattern on the one surface of the dielectric board to the ground pattern, so that the conductive pattern is short-circuited with the ground pattern via the plurality of through holes.

Further, in the waveguide filter described above, a plurality of conductive through holes may be provided along the slit to extend from a region of the conductive pattern on the one surface to the other surface of the dielectric board, and the ground pattern may be provided on the other surface except for the regions where the plurality of through holes are exposed and the peripheries of these regions. In this case, the plurality of the exposed through holes are made connectable to the ground pattern via a plurality of switching elements.

According to another aspect of this invention, it provides a communication access device having a waveguide filter described in any one of the paragraphs above.

The waveguide filter according to the aspect of this invention is capable of changing the central frequency easily by changing the width of the slit of the conductive pattern provided on the dielectric board mounted to a waveguide, without the need of changing the shape, particularly the cross-sectional shape of the metal fin or the waveguide.

BEST MODE FOR CARRYING OUT THE INVENTION

Figure 1A:
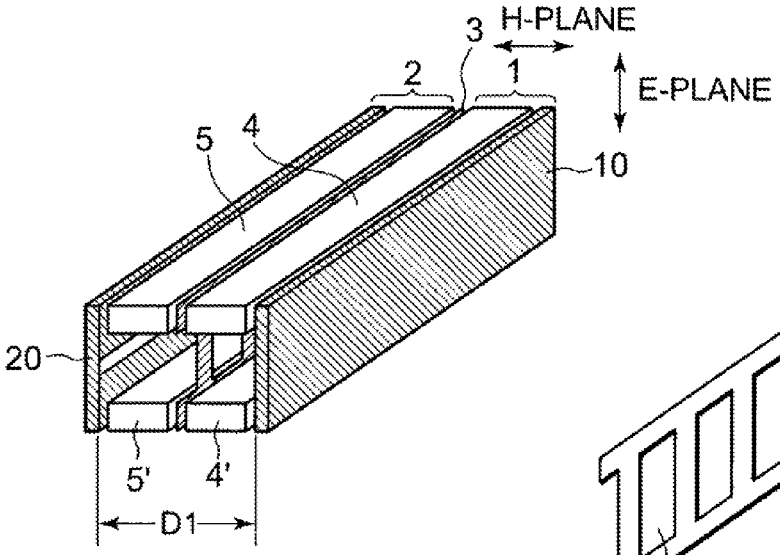
FIG. 1A is a perspective view showing an E-plane waveguide-type BPF according to a first exemplary embodiment of this invention.
Figure 1B:
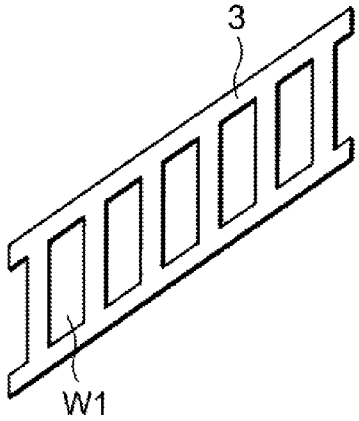
FIG. 1B is a perspective view showing a metal fin which is a part of the E-plane waveguide-type BPF shown in FIG. 1A.

Referring to FIGS. 1A and 1B, description will be made of an E-plane waveguide-type BPF according to a first exemplary embodiment of this invention.

In FIG. 1A, the E-plane waveguide-type BPF is formed by dividing a rectangular waveguide into halves 1 and 2 along a signal propagation direction in an H-plane, and interposing a metal fin 3 having a plurality of windows W1 as shown in FIG. 1B between the halves 1 and 2. In the halves 1 and 2, a part of the waveguide corresponding to the E-planes, that is, waveguide walls are formed by dielectric boards 10 and 20 instead of metal walls.

Figure 2A:
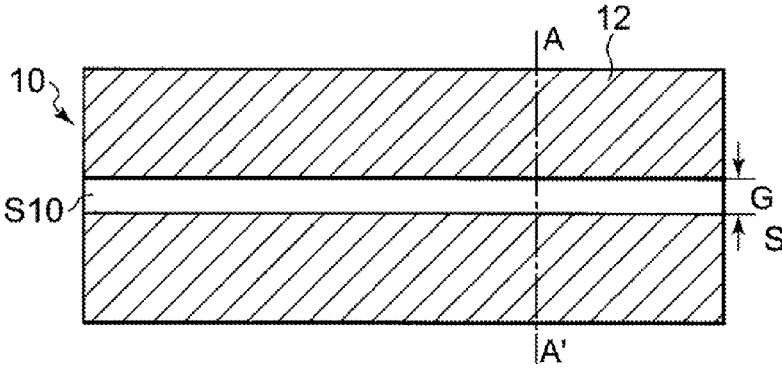
FIG. 2A is a diagram, as viewed from the inner side, showing a dielectric board which is a part of the E-plane waveguide-type BPF shown in FIG. 1A.
Figure 2B:
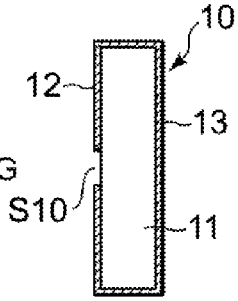
FIG. 2B is a cross-sectional view taken along the line A-A' of FIG. 2A.

Referring to FIGS. 2A and 2B, description will be made of the dielectric board 10. The dielectric board 10 has a substrate 11 made of a dielectric material. There is formed, on one surface of the dielectric board 10 located on the inner side of the waveguide, a conductive pattern 12 having a slit S10 which has a width G and extends in a signal propagation direction. A conductive pattern is formed on the entire remaining surface including the outer surface of the waveguide to form a ground pattern 13. In other words, the entire surface of the dielectric board 10 except for the slit S10 is covered with a ground pattern and a conductive pattern having the same potential as that of the ground pattern.

Although the dielectric board 20 is formed in the same structure as the dielectric board 10 in the first exemplary embodiment, only of the two side walls of the E-plane waveguide-type BPF may be replaced with the dielectric boards as described above. This applies to all the embodiments described later on.

Returning to FIG. 1A, the other parts than the dielectric boards 10 and 20 in the halves 1 and 2, that is, the parts corresponding to the upper and lower H-planes are metal walls 4, 4', 5, and 5'. When the dielectric boards 10 and 20 are mounted on these metal walls 4, 4', 5, and 5', the metal walls 4, 4', 5, and 5' become conductive with the respective conductive patterns on the dielectric boards 10 and 20. The method of mounting the dielectric boards 10 and 20 on the metal walls 4, 4', 5, and 5' is not limited particularly, and they may be mounted by various methods, such as screw cramping, welding, or bonding with a conductive adhesive.

Figure 3A:
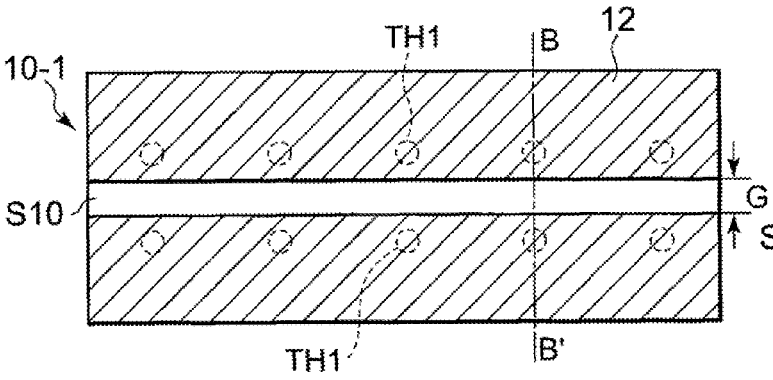
FIG. 3A is a diagram as viewed from the inner side, showing a dielectric board which is a part of an E-plane waveguide-type BPF according to a second exemplary embodiment of this invention.
Figure 3B:
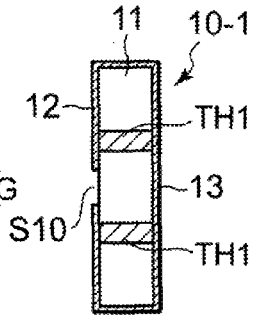
FIG. 3B is a cross-sectional view taken along the line B-B' of FIG. 3A.

FIGS. 3A and 3B show a second exemplary embodiment in which this invention is applied to a similar E-plane waveguide-type BPF to that of the first exemplary embodiment shown in FIG. 1, and particularly show the same part of the dielectric board as FIGS. 2A and 2B. Therefore, like parts to those of FIGS. 1A, 2A and 2B are assigned with like reference numerals and detailed description thereof will be omitted.

A dielectric board 10-1 according to the second exemplary embodiment has a plurality of through holes TH1 passing through a substrate 11, the through holes TH1 being formed on the opposite sides of a slit S10 while being spaced from each other in a signal propagation direction along the slit S10. The through holes TH1 are filled with a conductive material. A conductive pattern 12 on the inner side and a ground pattern 13 on the outer side are thus electrically short-circuited with each other in the vicinity of the slit S10.

Both in the first and second exemplary embodiments, as described above, a dielectric board having a conductive pattern with a slit disposed on the inner side and a ground pattern disposed on the outer side is provided on at least one of the two sides (E-planes) of a rectangular waveguide, in parallel with the E-plane.

[Description of Operation of First and Second Embodiments]

Figure 4:
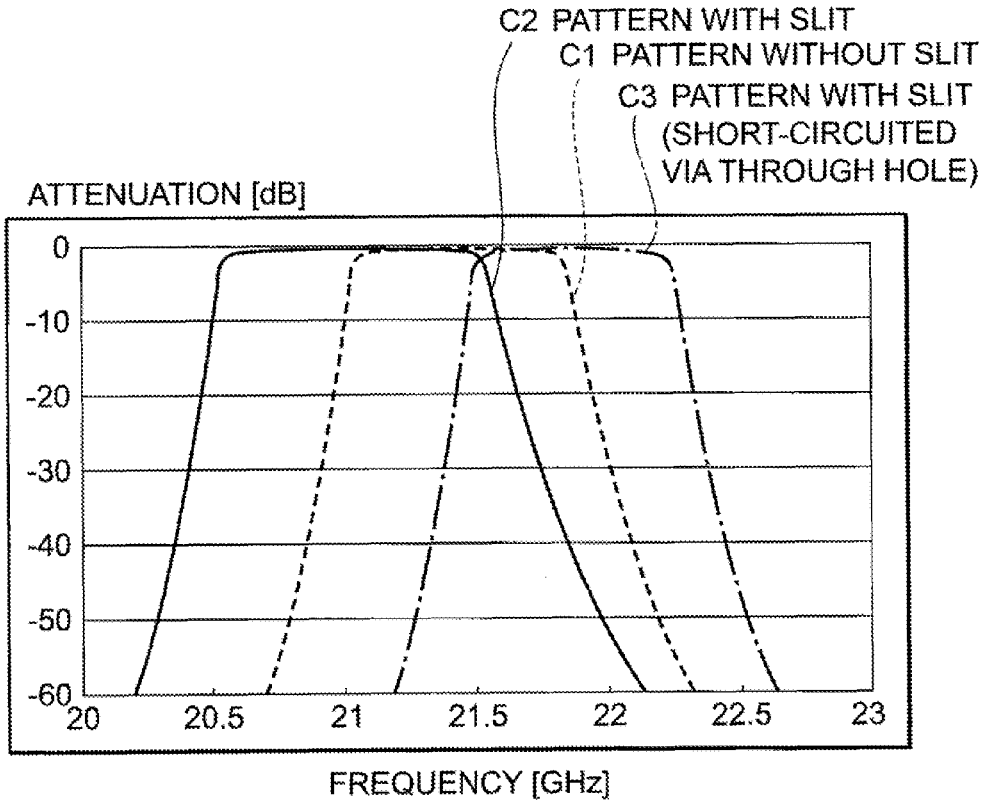
FIG. 4 is a diagram showing attenuation characteristics of a usual BPF and of an E-plane waveguide-type BPF of this invention when simulated with 22 GHz band.

FIG. 4 shows frequency-attenuation characteristics of three examples: a BPF having a conductive pattern without a slit (curve C1), a BPF having a conductive pattern with a slit (curve C2: the first exemplary embodiment), and a BPF in which a inner-side conductive pattern having a slit is short-circuited with an outer-side ground pattern through one or more through holes (curve C3: the second exemplary embodiment). The attenuation characteristics shown in FIG. 4 are of eight-stage BPFs (a metal fin 3 has eight windows W1) and obtained by simulation in 22-GHz band. In each example, the substrates forming the dielectric boards are made of Teflon (registered trademark).

As seen from the curve C2, the central frequency of the BPF according to the second exemplary embodiment is shifted to the lower side. This is because, as described in the first exemplary embodiment, the dielectric board having a conductive pattern with a slit formed on the inner side and made of a Teflon (registered trademark) substrate is disposed at a place corresponding to the E-plane parallel to the E-plane, whereby the same effect is obtained as when the length of the long side of the waveguide (the widthwise size D1 of the cross section of the rectangular waveguide: see FIG. 1A).

As seen from the curve C3, the central frequency of the BPF according to the second exemplary embodiment is shifted to the higher side. This is because, as described in the second exemplary embodiment, the inner side of the dielectric board having a conductive pattern with a slit formed thereon is short-circuited with the outer side having a ground pattern via the through holes formed in the substrate, at a plurality of places along the slit, whereby the same effect can be obtained as when the two E-planes of the waveguide are brought closer to each other.

Figure 5:
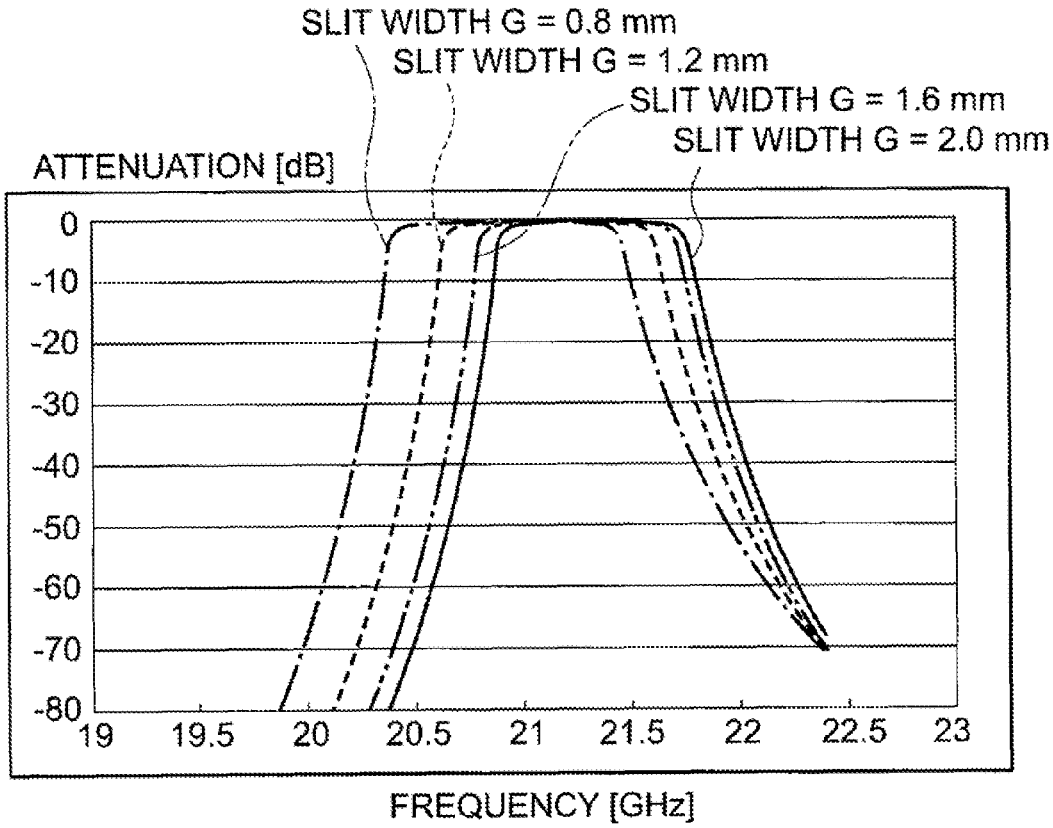
FIG. 5 is a diagram showing variation of the central frequency in an E-plane waveguide-type BPF of this invention caused by the change in the slit width G of a conductive pattern provided on a dielectric board.
Figure 6:
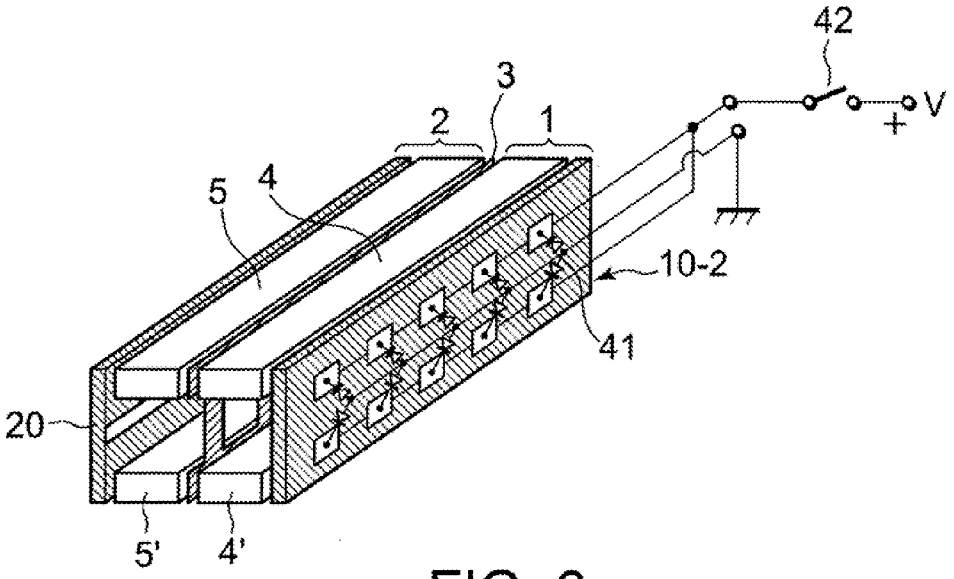
FIG. 6 is a perspective view showing an E-plane waveguide-type BPF according to a third exemplary embodiment of this invention.

FIG. 5 shows results of simulations for variation in the central frequency of a BPF caused by changing the slit width G of its conductive pattern with a slit. As seen from FIG. 5, the central frequency of the BPF can be shifted to the lower side by reducing the slit width G, whereas the central frequency can be shifted to the higher side by increasing the slit width G.

The first and second exemplary embodiments described above provide advantageous effects as follows.

(1) The central frequency of the E-plane waveguide-type BPF can be made variable without the need of changing the shape, particularly the cross-sectional shape of the metal fin or the waveguide, by changing the slit width G of a conductive pattern formed on the dielectric board attached to the waveguide, or by short-circuiting the inner-side conductive pattern to the outer-side ground pattern via the through holes in a region close to the slit.

(2) The central frequency of the E-plane waveguide-type BPF according to the first or second exemplary embodiment can be reduced by reducing the slit width G of the inner-side conductive pattern without the need of increasing the dielectric constant of the dielectric board attached to the waveguide or increasing the thickness of the dielectric board as a whole. Thus, this invention is capable of reducing the size of the BPF when compared with usual BPFs for passing the same frequency band.

Figure 7A:
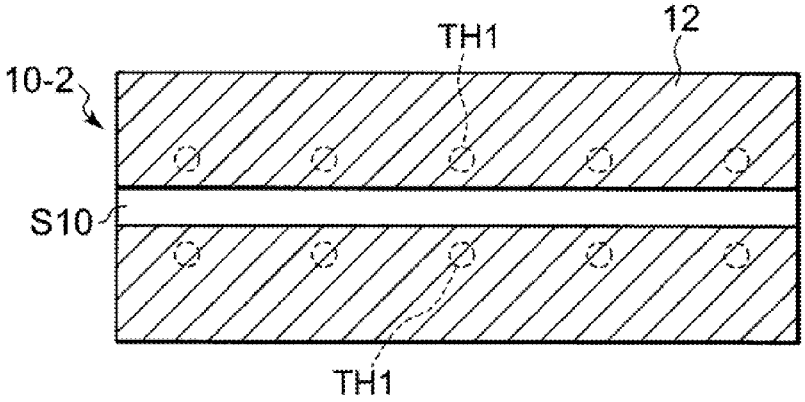
FIG. 7A is a diagram as viewed from the inner side, showing a dielectric board which is a part of the E-plane waveguide-type BPF according to the third exemplary embodiment of this invention.
Figure 7C:
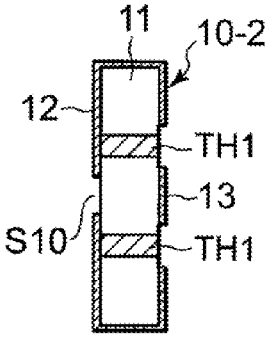
FIG. 7C is a cross-sectional view taken along the line C-C' of FIG. 7B.

FIG. 6 and FIGS. 7A to 7C show a third exemplary embodiment in which this invention is applied to an E-plane waveguide-type BPF similar to the one according to the second exemplary embodiment shown in FIGS. 3A and 3B. Particularly, FIGS. 7A and 7C show a part of the dielectric board similar to the one shown in FIGS. 3A and 3B. Therefore, like parts to those of FIG. 1A or FIGS. 3A and 3B are assigned with like reference numerals and detailed description thereof will be omitted.

Figure 7B:
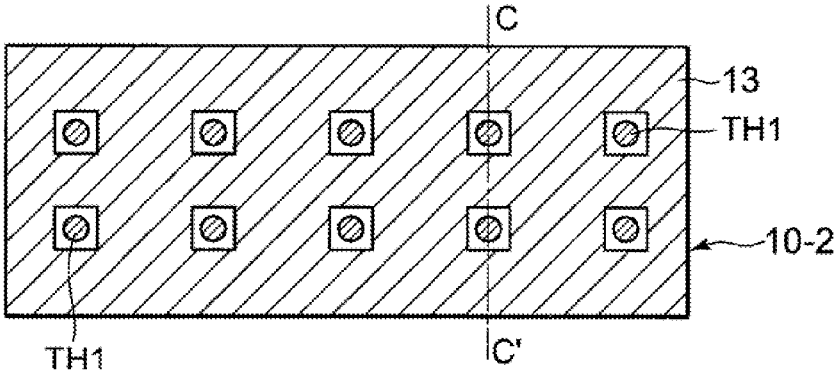
FIG. 7B is a diagram as viewed from the outer side, showing the dielectric board of FIG. 7A.

As shown in FIGS. 7A to 7C, a dielectric board 10-2 according to the third exemplary embodiment has a plurality of through holes TH1 passing through a substrate 11, the through holes TH1 being formed on the opposite sides of a slit S10 while being spaced from each other in a signal propagation direction along the slit S10. The through holes TH1 are filled with a conductive material. On the outer side of the dielectric board 10-2, the ground pattern is removed in the regions corresponding to the through holes TH1 and in the peripheries of these regions, whereby the exposed through holes TH1 are electrically isolated from the ground pattern 13. Under this configuration, the electrical connection between the through holes TH1 and the ground pattern 13 is turned on and off by means of switching elements.

Figure 8:
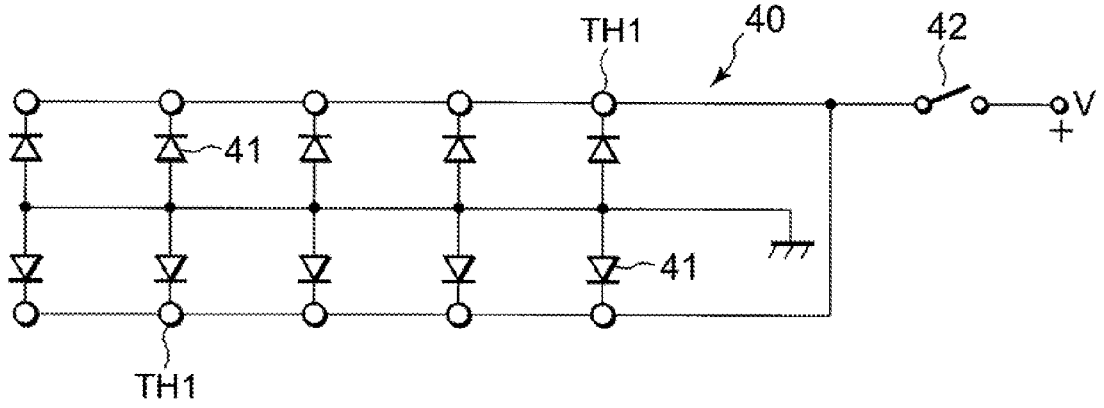
FIG. 8 is a diagram showing an example of a control circuit for controlling the turning on and off of the connection between a plurality of through holes and the ground in the E-plane waveguide-type BPF according to the third exemplary embodiment of this invention.

FIG. 8 shows an example of a control circuit 40 for turning on and off the switching elements. Although diodes 41 are employed as the switching elements in the control circuit 40 of this example, it should be understood that the invention is not limited to this and, for example, transistors may be used instead. In the control circuit 40 of this example, the through holes TH1 are connected in common to the positive side of a DC power supply through a switch 42, while the through holes TH1 are connected to the cathode of the respective diodes 41, and the anodes of the diode 41 are connected in common to the ground (or to the ground pattern 13). Each diode 41 has a threshold value (for example, of about several volts) for the inverse voltage, and the voltage of the DC power supply V is set equal to this threshold value.

According to this configuration of the control circuit 40, all the diodes 41 are turned on by turning on the switch 42, whereby the through holes TH1, and hence the conductive pattern 12 on the inner side of the dielectric board 10-2 is short-circuited with the ground in the vicinity of the slit S10. This state is equivalent to the state of the second exemplary embodiment.

In contrast, all the diodes 41 are turned off by turning off the switch 42, whereby the through holes TH1, and hence the conductive pattern 12 on the inner side of the dielectric board 10-2 is disconnected from the ground. This state is equivalent to the state of the first exemplary embodiment.

This enables the E-plane waveguide-type BPF according to the third exemplary embodiment to realize two types of attenuation characteristics represented by the curves C2 and C3 and illustrated in FIG. 4, that is, to change the central frequencies, by turning the switching elements on and off.

Figure 9:
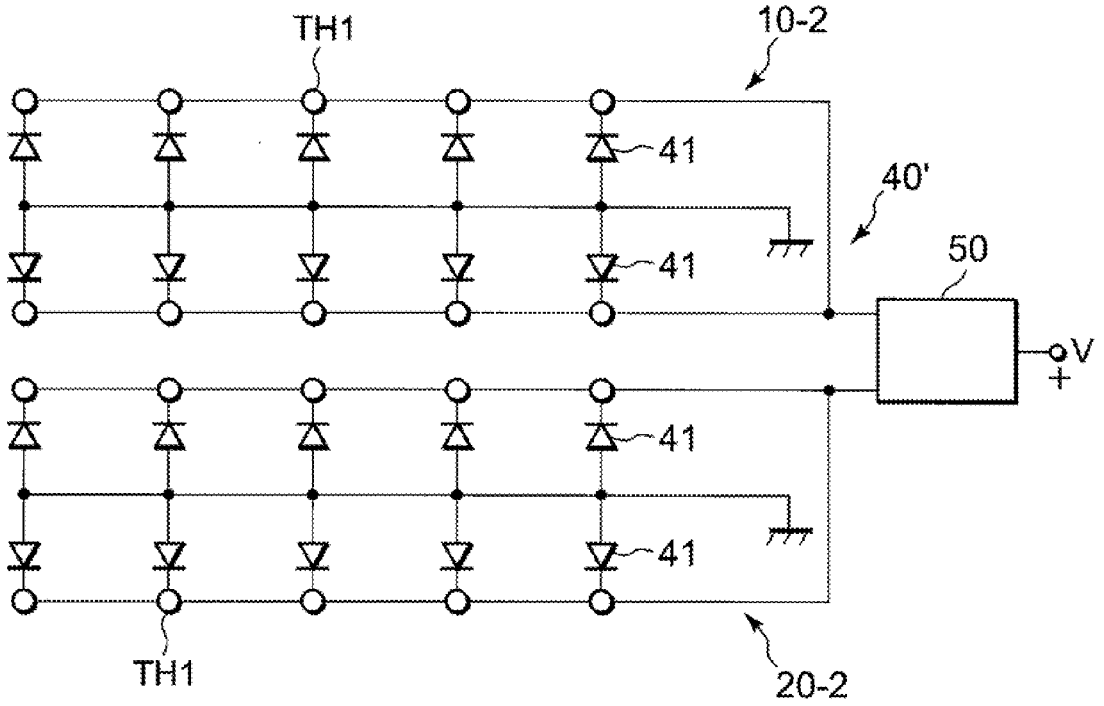
FIG. 9 is a diagram showing a control circuit employed in a first modification of the third exemplary embodiment.

When a dielectric board 10-2 and a dielectric boards 20-2 having the same structure as the dielectric board 10-2 are provided respectively on the two E-planes of the rectangular waveguide, another configuration described below is possible as a first modification of the third exemplary embodiment. Specifically, as shown in FIG. 9, a common control circuit 40' having a switching circuit 50 is used to perform control operations such that the switching elements 41 of both the dielectric boards 10-2 and 20-2 are turned on, only the switching elements 41 of one of the dielectric boards 10-2 and 20-2 are turned on, the switching elements 41 of both the dielectric boards 10-2 and 20-2 are turned off, and only the switching elements 41 of one of the dielectric boards 10-2 and 20-2 are turned off. This makes it possible to change the central frequency to three different levels.

Figure 10:
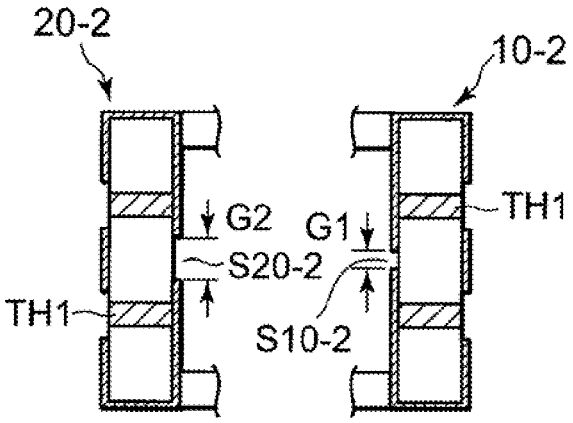
FIG. 10 is a cross-sectional view showing dielectric boards disposed on the opposite sides in a second modification of the third exemplary embodiment.

Still another configuration is possible, as a second modification of the third exemplary embodiment, in which as shown in FIG. 10, the conductive patterns of the dielectric boards 10-2 and 20-2 may be provided with slits S10-2 and S20-2 having mutually different widths G1 and G2. In this case, the switching circuit 50 in the control circuit 40' common for the dielectric boards 10-2 and 20-2 as illustrated in FIG. 9 is designed to perform the following four switch operations:

(1) The switching elements 41 of both the dielectric boards 10-2 and 20-2 are turned on;

(2) Only the switching elements 41 of one of the dielectric boards 10-2 and 20-2 are turned on;

(3) Only the switching elements 41 of the other dielectric board 10-2 or 20-2 are turned on; and (4) The switching elements 41 of both the dielectric boards 10-2 and 20-2 are turned off.

The central frequency of the E-plane waveguide-type BPF can be changed to four different levels by performing the switch control operations (1) to (4) as described above. This makes it possible to provide a BPF having a broad bandwidth of 1 GHz or more.

As described above, the E-plane waveguide-type BPF according to the third exemplary embodiment is capable of dynamically varying the central frequency and, moreover, is capable of increasing the variable range of the central frequency.

Figure 11:
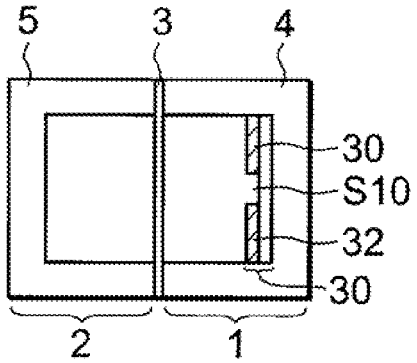
FIG. 11 is a diagram as viewed from a signal propagation direction, showing an E-plane waveguide-type BPF according to a fourth exemplary embodiment of this invention.
Figure 12:
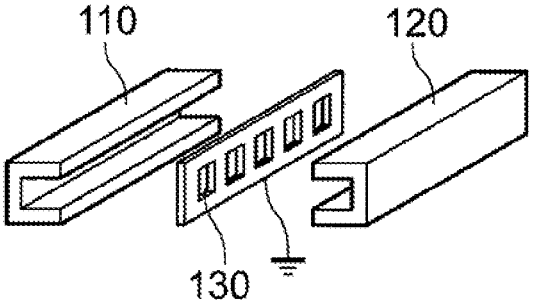
(RELATED ART) FIG. 12
FIG. 12 is an exploded perspective view for explaining an example of a usual E-plane waveguide-type BPF.

FIG. 11 shows a fourth exemplary embodiment of this invention. In the fourth exemplary embodiment, instead of mounting the dielectric boards in place of the side walls (E-planes) of the rectangular waveguide, a dielectric board 30 is provided on an inner wall (E-plane) of a usual rectangular waveguide so as to be parallel with the E-plane. Although in FIG. 11, the dielectric board 30 has a structure in which a conductive pattern 32 having a slit S10 is formed on one face (on the inner side of the waveguide) of a substrate 31, the dielectric board 30 may be replaced with any of the dielectric boards according to the first to third exemplary embodiments described above. Further, although in FIG. 11, the dielectric board 30 is provided only on the halve 1, the dielectric board 30 may be provided also on the halve 2 as described above.

Although this invention has been described above in terms of the first to fourth exemplary embodiments, it should be understood that the invention is not limited to these exemplary embodiments. Various changes and modifications may be made in configurations and details of this invention by those skilled in the art without departing from the scope and spirit of this invention set forth in the following claims. For example, several different types of dielectric boards having slits S10 with different widths G may be prepared to be exchangeable with each other so that an appropriate central frequency can be selected, as described in FIG. 5. Further, one of the two E-planes of the waveguide may be replaced with a dielectric board according to the third exemplary embodiment while the other E-plane may be replaced with a dielectric board according to the first or second exemplary embodiment.

INDUSTRIAL APPLICABILITY

A high-frequency BPF is employed for removing unnecessary waves at a high-frequency input/output portion of a millimeter wave band wireless access system. Such a high-frequency BPF is required to have broad bandwidth, high attenuation, and low loss. A 23-GHz band wireless access system, for example, has a usable frequency bandwidth which is as broad as 2 GHz. Since it is impossible to cover such a broad frequency bandwidth with a single type of BPF according to usual techniques, it has been a usual practice to divide the used bandwidth and to prepare a plurality of BPFs so that an appropriate one of them is used according to a used bandwidth division. Further, since BPFs for different used bandwidths are physically different from each other, several systems are also required for mounting these BPFs even if the systems are all for 23-GHz band.

In contrast, using the E-plane waveguide-type BPF according to this invention, the bandwidth of 23 GHz can be fully covered with a single type of BPF, and hence it is sufficient to prepare a single type of the system. This provides great benefits in terms of production and usability.

The invention claimed is

1. A waveguide filter comprising;

first and second halves formed by dividing a rectangular waveguide along a signal propagation direction in an H-plane, the rectangular waveguide comprising two E-planes corresponding to the first and second halves;

a metal fin having a plurality of windows and sandwiched between the first and second halves; and at least one dielectric portion that forms a waveguide wall corresponding to the E-plane of at least one of the first and second halves;

one surface of the at least one dielectric portion, which is located on an inner side of the rectangular waveguide being provided with a conductive pattern having a single slit extending through a total length of the rectangular waveguide in the signal propagation direction.

2. The waveguide filter as claimed in claim 1, wherein the at least one dielectric portion further comprises a ground pattern formed on the other surface thereof.

3. A communication access device comprising a waveguide filter as claimed in claim 1.

4. The waveguide filter as claimed in claim 2, wherein the at least one dielectric portion is a first dielectric board made of a dielectric material.

5. The waveguide filter as claimed in claim 4, wherein the at least one dielectric portion further comprises a second dielectric board which forms another waveguide wall, both of the waveguide walls respectively define the two E-planes of the rectangular waveguide.

6. The waveguide filter as claimed in claim 5, wherein a plurality of conductive through holes are provided along the single slit to extend from a region of the conductive pattern on the one surface of the first dielectric board to the other surface of the first dielectric board, the ground pattern is provided on the other surface except for regions where the plurality of conductive through holes are exposed and respective peripheries of the regions, and the plurality of the exposed conductive through holes are connected to the ground pattern via a plurality of switching elements.

7. The waveguide filter as claimed in claim 6, comprising a control unit for controlling the turning on and off of the plurality of switching elements.

8. The waveguide filter as claimed in claim 7, wherein the at least one dielectric portion further comprises a second dielectric board which forms another waveguide wall, both of the waveguide walls respectively define the two E-planes of the rectangular waveguide, and the control unit is provided to perform control operations to turn off the plurality of switching elements of both of the first and second dielectric boards, to turn on the plurality of switching elements of one of the first and second dielectric boards, and to turn on the plurality of switching elements of both of the first and second dielectric boards, whereby the central frequency of the waveguide filter can be changed to three different levels.

9. The waveguide filter as claimed in claim 7, wherein the at least one dielectric portion further comprises a second dielectric board which forms another waveguide wall, wherein each of the first and second dielectric boards comprises the single slit; both of the waveguide walls respectively define the two E-planes of the rectangular waveguide, while the widths of the respective single slits of the first and second dielectric boards are differed from each other, and the control unit is provided to perform on/off control operations in four different levels consisting of turning off the plurality of switching elements of both of the first and second dielectric boards, turning on the plurality of switching elements only of one of the first and second dielectric boards, turning on the plurality of switching elements only of another one of the first and second dielectric board, and turning on the plurality of switching elements of both of the two dielectric boards, whereby the central frequency of the waveguide filter can be changed to four different levels.

10. The waveguide filter as claimed in claim 4, wherein a conductive through hole is provided to extend from a region of the conductive pattern on the one surface of the first dielectric board to the ground pattern, whereby the conductive pattern is short-circuited with the ground pattern via the conductive through hole.

11. The waveguide filter as claimed in claim 10, wherein the conductive through hole is provided in plurality along the single slit.

* * * * *